US005870775A

United States Patent [19]

Noyola

[11] Patent Number: 5,870,775

[45] Date of Patent: Feb. 16, 1999

[54] OUTERWEAR GARMENT HAVING COMPARTMENTED SEAT SECTION

[76] Inventor: Rufino Noyola, 3423 Deere Rd., Decatur, Ala. 35603

[21] Appl. No.: 918,391

[22] Filed: Aug. 26, 1997

[51] Int. Cl.[6] ..... A41D 15/00; A41D 1/06; A41B 9/00

[52] U.S. Cl. ..... 2/69; 2/228; 2/400; 2/94; 2/227; 450/98

[58] Field of Search ..... 450/95, 98, 108, 450/149, 150; 2/94, 69, 215, 400, 227, 228, 235, 238, 22, 23

[56] References Cited

U.S. PATENT DOCUMENTS

| | | |
|---|---|---|
| 2,179,631 | 11/1939 | Holder . |
| 2,332,141 | 10/1943 | Greene . |
| 2,807,805 | 10/1957 | Allan . |
| 3,137,862 | 6/1964 | Mizerak . |
| 3,295,530 | 1/1967 | Mayer et al. . |
| 4,006,494 | 2/1977 | Knoppel . |
| 4,894,867 | 1/1990 | Ceravolo et al. . |
| 4,969,216 | 11/1990 | Guelli . |
| 5,040,243 | 8/1991 | Tatsuno . |
| 5,103,505 | 4/1992 | Llorens . |
| 5,497,511 | 3/1996 | Zade . |
| 5,561,865 | 10/1996 | Fjelstul . |
| 5,564,125 | 10/1996 | Waldman et al. . |
| 5,649,328 | 7/1997 | Martin . |
| 5,706,523 | 1/1998 | Witzel . |
| 5,724,679 | 3/1998 | Hans . |
| 5,749,101 | 5/1998 | Breindel . |

*Primary Examiner*—Michael A. Neas
*Assistant Examiner*—Shirra L. Jenkins
*Attorney, Agent, or Firm*—John C. Garvin, Jr.

[57] ABSTRACT

An outerwear garment including a pair of pants or trousers having a waist section, a seat section, and leg section; a pair of storage compartments in the seat section of the pants; a cushion stored in one of the storage compartments in the seat section of the pants; and a rainjacket attached to the other of the storage compartments in the seat section of the pants and being normally stored therein but which can be readily removed therefrom by a person and donned by such person at his option.

16 Claims, 2 Drawing Sheets

OUTERWEAR GARMENT HAVING COMPARTMENTED SEAT SECTION

FIELD OF THE INVENTION

The present invention relates to wearing apparel and particularly to wearing apparel such as a pair of pants (or shorts) having a compartmented rear seat for storing a cushion and other wearing apparel such as a rainjacket.

BACKGROUND OF THE INVENTION

When a person is in an outdoor environment such as being at a football game, baseball game, track meet, fishing, or the like, the person tends to dress according to the weather conditions which exist prior to his departure from home or in accordance with the forecast of meteorologists. If it is raining or snowing or if the meteorologists are predicting rain or snow, the person often wears or carries by hand, or in cumbersome separate bags or pouches items such as a rainjacket, raincoat, umbrella or the like to protect himself against the rain or snow. If the weather is fair and clear and there are no predictions of rain or snow, the person need not pack such items to protect himself against the elements. Regardless of the actual or predicted weather conditions, many people take cushions with them when going to an outdoor environment to sit upon for comfort.

If it is not raining or snowing upon arriving at the outdoor environment, it is not necessary for a person to be wearing the rainjacket, raincoat or the like or having the umbrella in its erect, protecting, condition. Should it begin to precipitate, convenient and ready accessibility to a rainjacket, raincoat or the like is highly desirable. Once the precipitation stops, the person might want to easily and conveniently remove the rainjacket, raincoat, or the like and store it neatly away without carrying it by hand, or in some cumbersome separate bag or the like.

Several attempts have been made in the prior art to provide outer wear garments having self-contained carriers for such outer wear garments, as is exemplified in U.S. Pat. No. 3,389,407 to Morrison; U.S. Pat. No. 5,040,243 to Tatsuno; and U.S. Pat. No. 5,564,125 to Waldman et al. U.S. Pat. No. 3,389,407 to Morrison discloses a rain garment including connected jacket, trousers and head covering parts with compartments built into the jacket part for storing the head covering part and trousers. U.S. Pat. No. 5,040,243 to Tatsuno discloses a main garment provided with a sack on its back side for storing a secondary garment normally packaged in the sack and adapted to be easily removed from the sack and worn over the main garment and returned to the sack as required. U.S. Pat. No. 5,564,125 to Waldman et al. discloses a combination upper torso outerwear garment and carrier therefor which is adapted to being worn about the waist of a user irrespective of whether the outerwear garment is in a worn or a stored condition.

Attempts have also been made in the prior art to provide combination cushion and outerwear garments or waist packs, such as exemplified in U.S. Pat. No. 5,101,514 to Eklund and U.S. Pat. No. 5,275,315 to Carmack et al. U.S. Pat. No. 5,101,514 to Eklund discloses a jacket or garment having a cushion secured thereto for the user to sit upon for comfort. U.S. Pat. No. 5,275,315 to Carmack et al. discloses a pack that is to be worn about the waist of a human which includes a seat cushion to be used by the human when sitting.

SUMMARY OF THE INVENTION

The present invention is directed to a outerwear garment and comprises a pair of pants or trousers, a cushion stored within a first compartment within the seat section of the pants or trousers for comfort, and a rainjacket stored within a second compartment within the seat section of the pants or trousers and which can be readily donned by a person should it begin to precipitate rain or snow.

An object of the present invention is to provide a simple outerwear garment which is adapted to be worn by a person and which provides a compartment for storing a seat cushion thereby eliminating the need to carry a separate seat cushion to an environment where there is a need for a seat cushion.

Another object of the present invention is to provide an outerwear garment having compartments for storing a seat cushion and a rainjacket which can be stored when not needed but which can be readily removed from the storage compartment within the outerwear garment should it begin to precipitate.

These objects as well as other objects of the present invention will become more readily apparent after reading the following description in conjunction with the accompanying drawings.

DETAILED DESCRIPTION OF THE PREFERRED EMBODIMENT OF THE INVENTION

Figure 1:
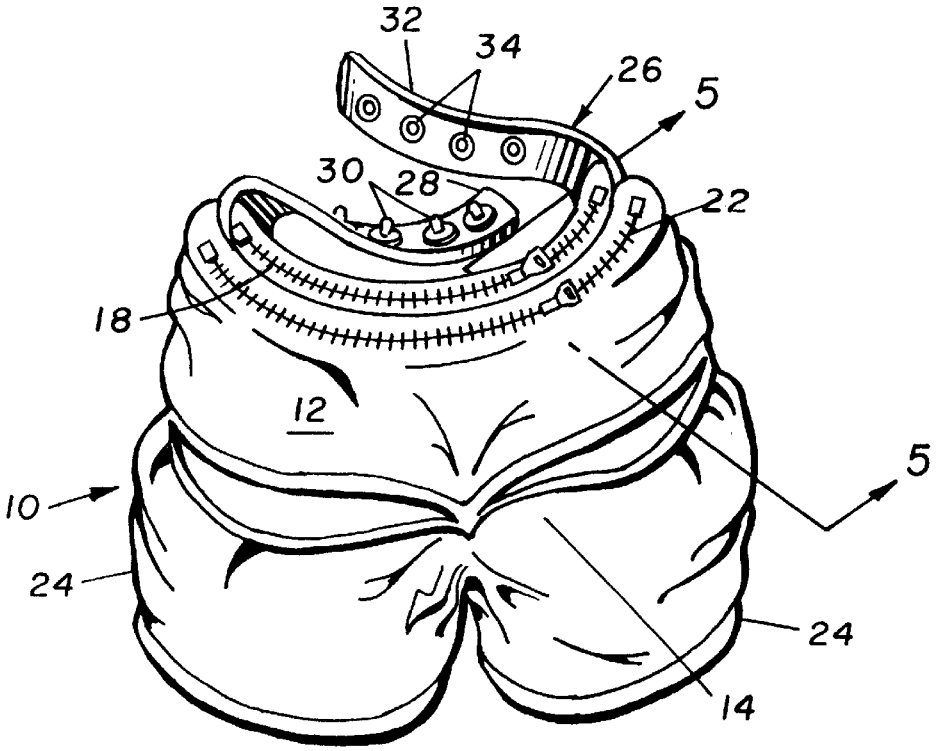
FIG. 1 is a rear perspective view of the pants having a first compartment in the seat section of the pants for storing a cushion, and a second compartment in the seat section for storing other wearing apparel such as a rainjacket.
Figure 2:
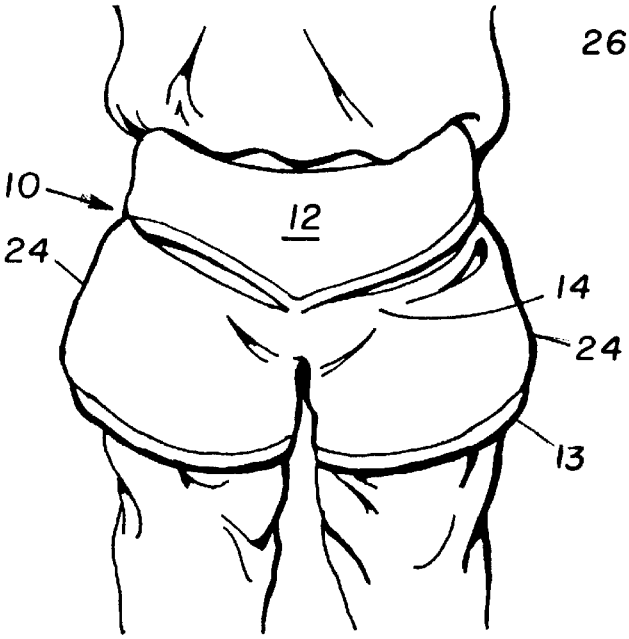
FIG. 2 is a rear perspective view illustrating the pants of FIG. 1 being worn by a person.
Figure 3:
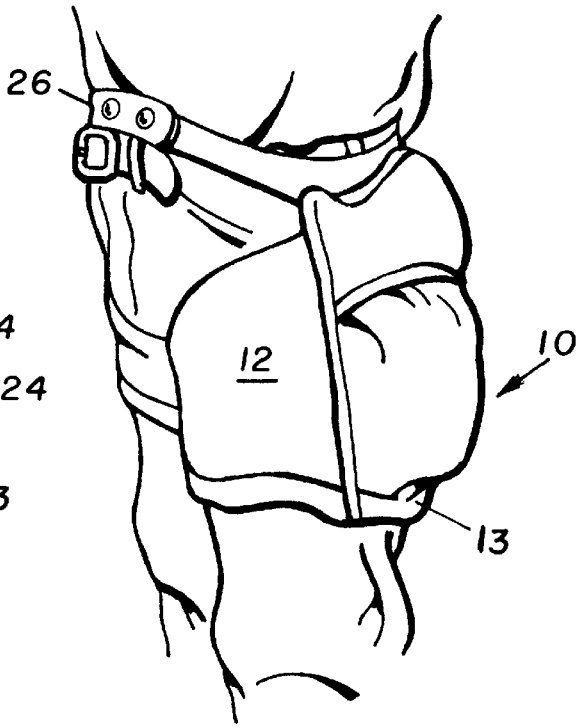
FIG. 3 is a side perspective view of the pants as illustrated in FIG. 2.
Figure 4:
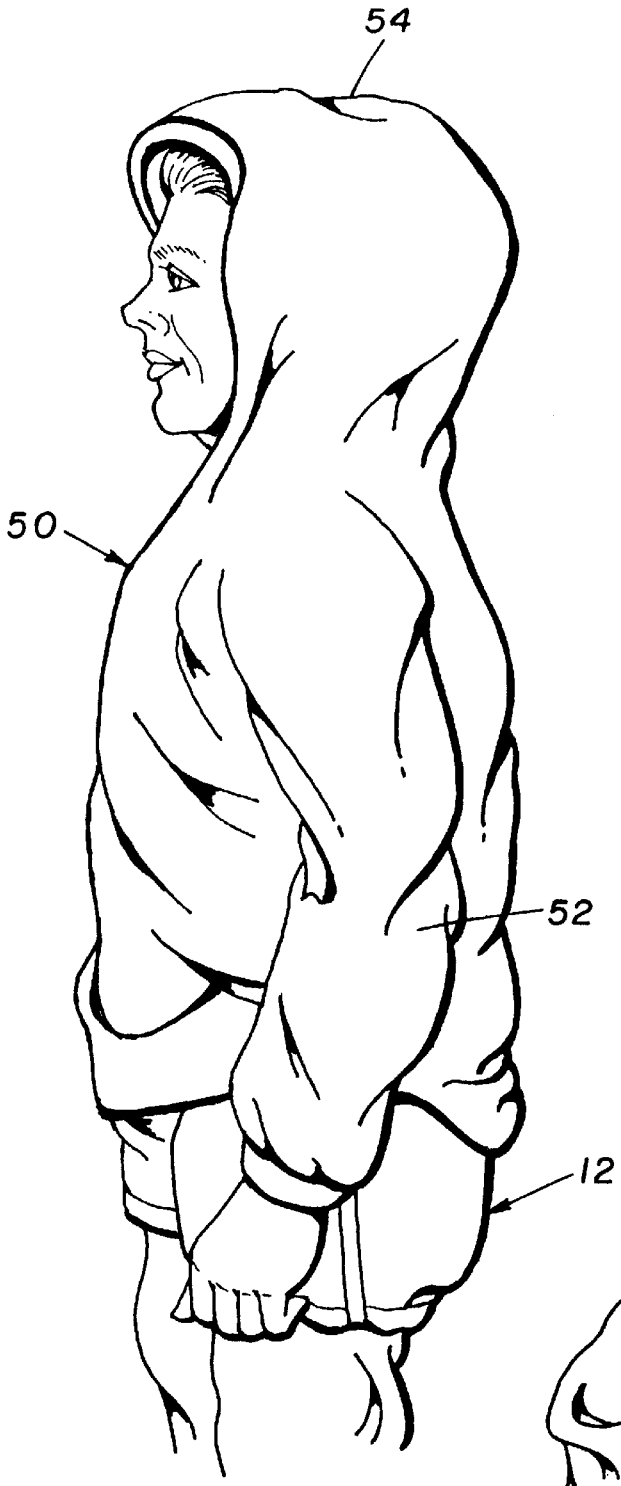
FIG. 4 is a side perspective view similar to that of FIG. 3 but illustrating the rainjacket removed from its storage compartment and being worn by a person.
Figure 5:
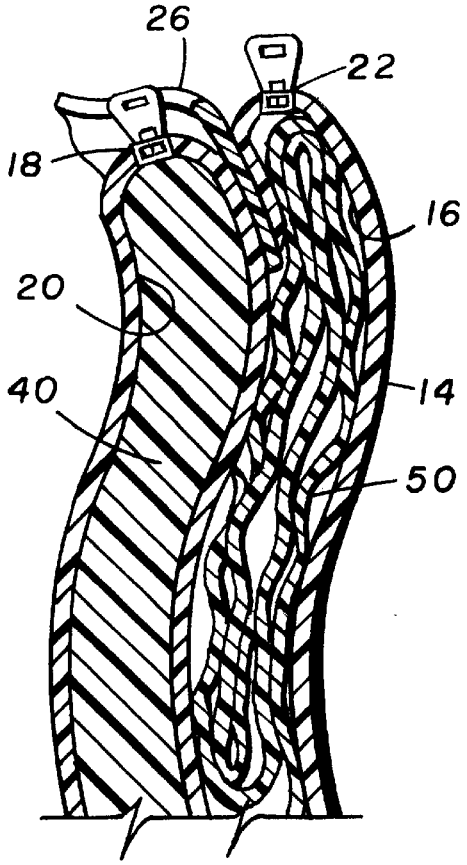
FIG. 5 is an enlarged sectional, fragmentary, view of the pants, cushion within the seat of the pants, rainjacket, and storage compartments taken along line 5—5 of FIG. 1.
Figure 6:
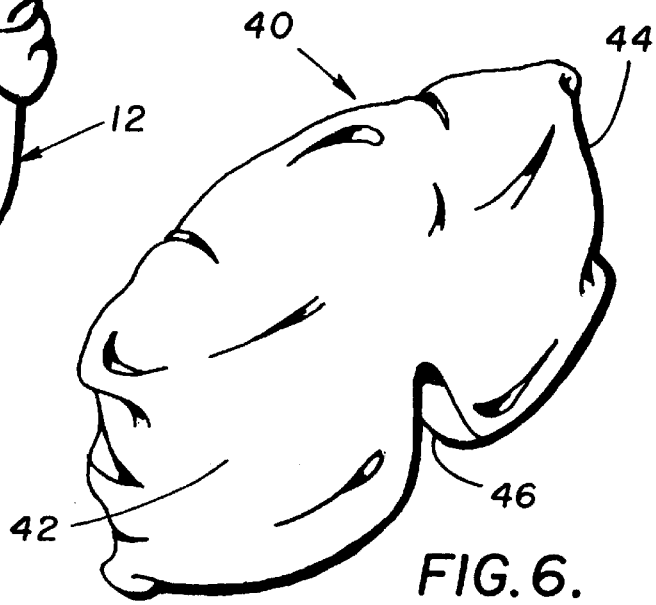
FIG. 6 is a rear perspective view of a preferred cushion for placing within a storage compartment within the seat of the pants.

Referring now to the drawings, reference numeral 10 generally designates the wearing apparel of the present invention. As best seen in FIGS. 1–3 and 5, wearing apparel 10 comprises a pair of pants or trousers 12 having a seat portion 14, a first storage compartment 16 within the seat portion 14, a first closure mechanism 18 for opening and closing first compartment 16, a second storage compartment 20 within seat portion 14, a second closure mechanism 22 for opening and closing the second compartment 20, and a pair of pant legs 24. As best seen in FIG. 5, the first and second compartments 16 and 20 are defined by an inner wall portion 19, an outer wall portion 17, and have a common wall or intermediate wall portion 21 separating them. Pants or trousers 12 further includes a belt 26 secured thereto by any suitable means such as stitching to the common wall 21 in its waist area with belt 26 including a first end portion 28 having a plurality of male fasteners 30 attached thereto and a second end portion 32 having a plurality of female fasteners 34 attached thereto. A cushion 40 is stored in the first compartment 16 of seat portion 14 of pants or trousers 12. As best seen in FIG. 6, the preferred embodiment of cushion 40 includes a first side section 42, a second side section 44 and a partial slit 46. A rainjacket 50 is stored in the second compartment 20 of seat portion 14 of pants or trousers 12. Rainjacket 50 includes a pair of long sleeves 52, a hood 54, and means (not shown) such as a zipper mechanism, male and female fasteners, and hook and closure materials for opening and closing the front of rainjacket 50. Rainjacket 50 is secured at its lower back to the common wall 21 of first and second compartments 16 and 20 in the rear waist area of the pants or trousers 12 by any suitable means such as stitching. The closure mechanisms 18 and 22 may be of any desired type such as a zipper, hook and closure material, buckles, snaps, buttons and the like. In the illustrated embodiment, the closure mechanisms are in the form of a zipper. The legs of pants 12 can be either of a short length (just above the knees) or of a full length (just above the feet). As is apparent, each of the compartments 16 and 20 must have a bottom. In the short pants version of garment 10 as shown in the drawings, the bottom of compartment 16 which stores rainjacket 50, may be in the order of five or seven inches below the belt 26 as it would be in the long pant version of the garment. In the short pants version of garment 10 as shown in the drawings, the bottom of compartment 20 is at seam 13 of pant legs 24 of pants 12. In the long pants version of garment 10, the bottom of compartment 20 would be in the same general area of the pant legs in the order of three to five inches below the crotch (not numbered) of pants 12. Pants 12 can be made of any well known water repelling material such as treated cloth, plastic, leather or the like. The cushion 40 can be made of any well known material such as foam rubber, cotton, polyester or the like. The rainjacket 50 is shown as covering only the upper torso but it might be a full length (down to around the knees). Rainjacket 50 can be made of any well known material such as woven cloth treated with a water impervious substance, a flexible plastic which possesses water impervious characteristics, or the like.

While the above description constitutes the preferred embodiments of the present invention, it will be appreciated that the invention is susceptible to modification, variation and change without departing from the proper scope and fair meaning of the accompanying claims.

I claim:

1. A garment comprising a pair of pants having a seat section forming first and second discrete side-by-side storage compartments for storing various elements therein, said discrete storage compartments defined by spaced inner and outer wall portions formed in said seat section, and, an intermediate wall portion between said inner and outer wall portions, said intermediate wall portion being common to each compartment of said discrete storage compartments.

2. The garment of claim 1 wherein said intermediate wall portion is a continuation of said inner wall portion.

3. The garment of 2 further including means for accessing said first compartment.

4. The garment of claim 3 further including means for accessing said second compartment.

5. The garment of claim 4 wherein said means for accessing said first and second compartments are zipper closures.

6. The garment of claim 5 wherein said element stored in said first storage compartments comprises cushion means.

7. The garment of claim 6 wherein said element stored in said second storage compartment comprises a jacket including a pair of long sleeves and a head covering hood.

8. The garment of claim 7 further including belt means attached to said pants, and means for closing said belt means.

9. A garment comprising:

a pair of pants having a waist section, a seat section, and a leg section;

a first compartment provided in said seat section for removably storing a cushion means therein;

first access means for providing access into said compartment to store said cushion means a second compartment in said seat section for removably storing an upper torso wearing apparel therein; and second access means for providing access into said second compartment.

10. The garment of claim 9 wherein said first access means is an opening having first closure means for closing said opening.

11. The garment of claim 10 wherein said first closure means comprises a zipper closure.

12. The garment of claim 9 wherein second access means is an opening having second closure means for closing said opening.

13. The garment of claim 12 wherein said second closure means comprises a zipper closure.

14. The garment of claim 9 including belt means attached to said waist section of said pants, and means for closing said belt means.

15. The garment of claim 14 wherein said means for closing said belt includes male and female fasteners.

16. The garment of claim 9 wherein said upper torso wearing apparel comprises a rainjacket including a pair of long sleeves and a head covering hood.

* * * * *